US006371824B1

(12) United States Patent
Brown

(10) Patent No.: US 6,371,824 B1
(45) Date of Patent: Apr. 16, 2002

(54) YO-YO AND METHOD FOR USING A YO-YO

(75) Inventor: Stephen D. Brown, Tallahassee, FL (US)

(73) Assignee: Flambeau Products Corporation, Middlefield, OH (US)

( * ) Notice: Subject to any disclaimer, the term of this patent is extended or adjusted under 35 U.S.C. 154(b) by 0 days.

(21) Appl. No.: 09/561,495

(22) Filed: Apr. 28, 2000

(51) Int. Cl.[7] ..... A63H 1/30
(52) U.S. Cl. ..... 446/250
(58) Field of Search ..... 446/250, 251

(56) References Cited

U.S. PATENT DOCUMENTS

| | | | | |
|---|---|---|---|---|
| 1,779,620 A | * | 10/1930 | Romero | 446/250 |
| 1,793,151 A | * | 2/1931 | Asbury et al. | 446/250 |
| 3,687,453 A | * | 8/1972 | Fraga | |
| 3,724,121 A | * | 4/1973 | Atkins et al. | |
| 3,834,069 A | | 9/1974 | Brown | |
| 5,947,790 A | * | 9/1999 | Gordon | |
| 6,123,596 A | * | 9/2000 | Hsu | 446/250 |

FOREIGN PATENT DOCUMENTS

| | | | |
|---|---|---|---|
| EP | 653228 | * 11/1994 | |
| FR | 757917 | * 1/1934 | 446/250 |
| GB | 10311 | * of 1898 | 446/251 |

* cited by examiner

*Primary Examiner*—John A. Ricci
(74) *Attorney, Agent, or Firm*—Michael Best & Friedrich LLP

(57) ABSTRACT

A yo-yo includes a yo-yo body having first and second halves joined together with an axle. A string is interconnected at one end to the axle and at the opposite end to a solid body. Tricks may be executed using the yo-yo, including selectively releasing the solid body, supporting the yo-yo by the string at a point on the string between the solid body and the yo-yo body, and throwing the yo-yo body and solid body in the air and catching the solid body.

9 Claims, 3 Drawing Sheets

YO-YO AND METHOD FOR USING A YO-YO

FIELD OF THE INVENTION

The invention relates to a yo-yo apparatus and a method for playing with a yo-yo.

BACKGROUND

It is known to provide a yo-yo having first and second body halves, an axle joining the body halves, and a string attached to and windable about the axle. When using such known yo-yos, the player secures the free end of the string to one of the player's fingers, releases or throws the yo-yo body to cause the string to unwind, and performs tricks with the yo-yo as the yo-yo body spins at the end of the string.

SUMMARY

The present invention provides an improved yo-yo and an improved method for using the yo-yo. The yo-yo includes a yo-yo body having first and second halves, an axle joining the halves, and a string interconnected with and windable about the axle. Additionally, the yo-yo includes a solid body secured to the free end of the string. Preferably, the solid body is a die or rubber ball, but any suitable solid body may be used.

A method for using the above-described yo-yo includes spinning the yo-yo body at the end of the string while holding onto the solid body in the player's hand, and selectively releasing and holding the solid body while the yo-yo body is spinning. Preferably, the method includes supporting the yo-yo by holding the string at a point between the solid body and the yo-yo body while moving the yo-yo body and/or the solid body with respect to the point.

Other features and advantages of the invention will become apparent to those skilled in the art upon review of the following detailed description, claims, and drawings.

Figure 1:
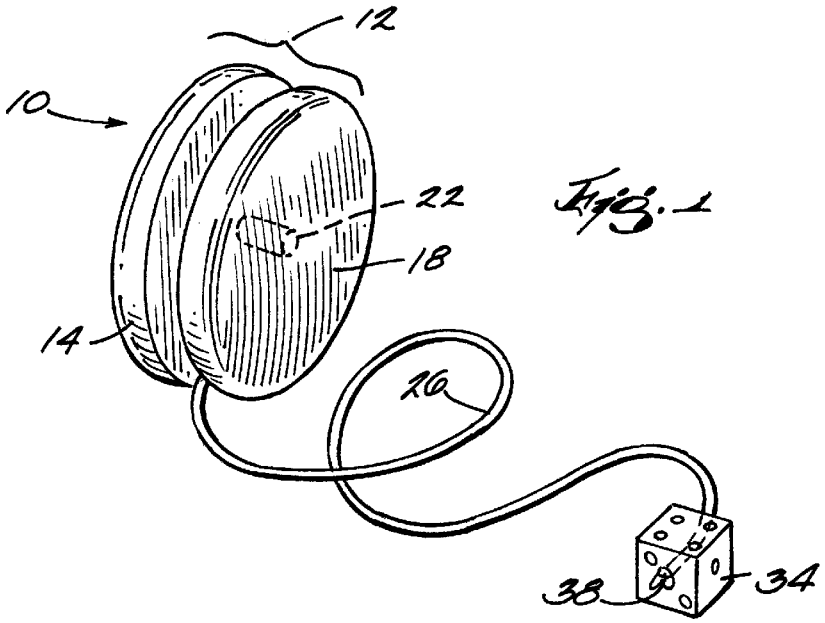
FIG. 1 is a perspective view of a yo-yo embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DETAILED DESCRIPTION

Figure 2:
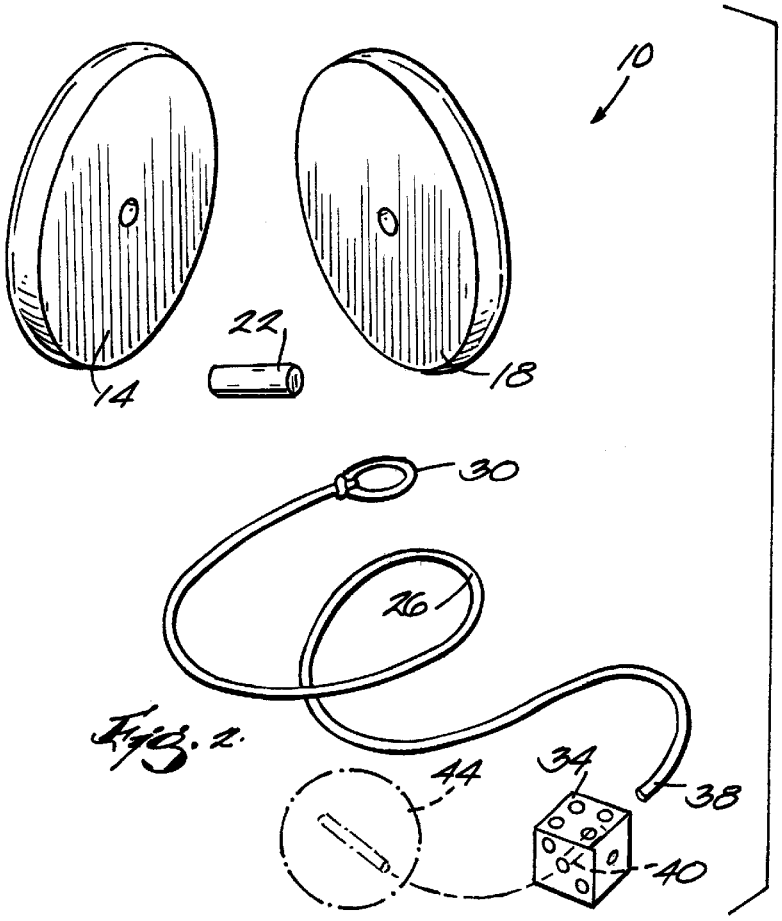
FIG. 2 is an exploded view of the yo-yo of FIG. 1.

FIGS. 1 and 2 illustrate a yo-yo 10 embodying the present invention. The yo-yo 10 includes a yo-yo body 12 having first and second body halves 14, 18, an axle 22 joining the body halves 14, 18, a string 26 having a first end 30 interconnected with the axle 22, and a solid body, gripper member, or weight 34 secured to a second end 38 of the string 26. As used herein, "solid body" refers to any mass that may be interconnected with the string, whether the mass is solid or hollow, or whether the mass includes a liquid or other flowable substance or gas component. As an added feature to the present invention, the solid body may be luminescent, reflective, or fluorescent, or the solid body may include a light, such pas an LED, or may include a strobe light to enhance play.

The illustrated solid body 34 is a die having a hole 40 formed through it to facilitate tying the string 26 to the solid body 34. Alternatively, the solid body 34 may be a rubber ball 44 (shown in phantom in FIG. 2) or substantially any other solid body that is preferred by the user. Also, the solid body 34 may not be connected to the end 38 of the string 26, but may be connected at another point on the string 26. It is also within the scope of the invention to interconnect more than one solid body 34 with the string 26, and/or permit one or more solid body 34 to slide on the string 26. In this regard, one or more stoppers may be secured at selected locations on the string 26 or the string 26 may be tied in a knot at selected locations to restrict movement of the solid body or bodies 34.

The basic method for playing with the yo-yo 10 is to throw the yo-yo body 12 down so that the yo-yo body 12 sleeps at the first end 30 of the string 26. As used herein, "sleeps" means that the yo-yo body 12 and axle 22 spin freely at the first end 30 of the string 26 without winding the string 26 about the axle 22. Then, with the yo-yo body 12 sleeping at the first end 30 of the string 26, the player performs a trick. The trick may include, for example, moving the solid body 34 from hand to hand, throwing the yo-yo 10 in the air and catching the solid body 34, and/or grasping the string 26 at a point between the solid body 34 and yo-yo body 12 and moving the solid body 34 and/or yo-yo body 12 with respect to the point.

Because the solid body 34 is employed instead of tying the second end 38 of the string to the player's finger as is traditional, many standard tricks may be enhanced. One example of a traditional yo-yo trick is commonly referred to as the Trapeze. The Trapeze is executed by a player having a first, throwing hand and second, free hand. To execute the Trapeze, a player ties the second end of the string to a finger of the first hand and throws the yo-yo body out to the side, causing the yo-yo to sleep and swing across the front of the player's body in an arc. As the yo-yo swings by the player's body, the player holds the second hand at substantially the same level as the first hand, and extends a finger of the second hand to catch the yo-yo string. The string bends around the finger of the second hand as the yo-yo body swings around the finger, and lands on the portion of the string between the first and second hands. To end the trick, the player quickly brings the first and second hands together and then apart, causing the yo-yo body to swing back around the finger of the second hand.

Figure 3:
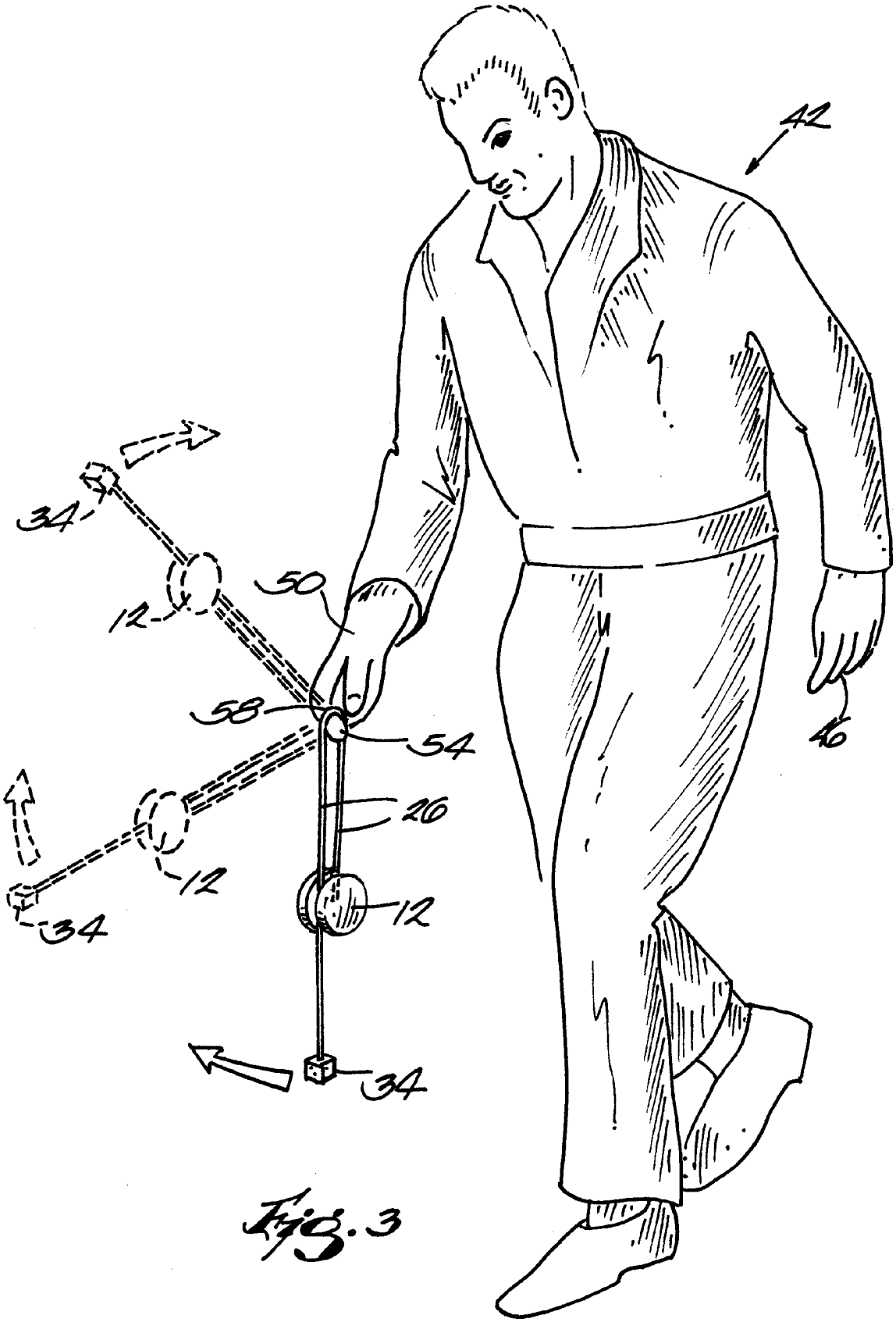
FIG. 3 is an illustration of a player using the yo-yo of FIG. 1.
Figure 4:
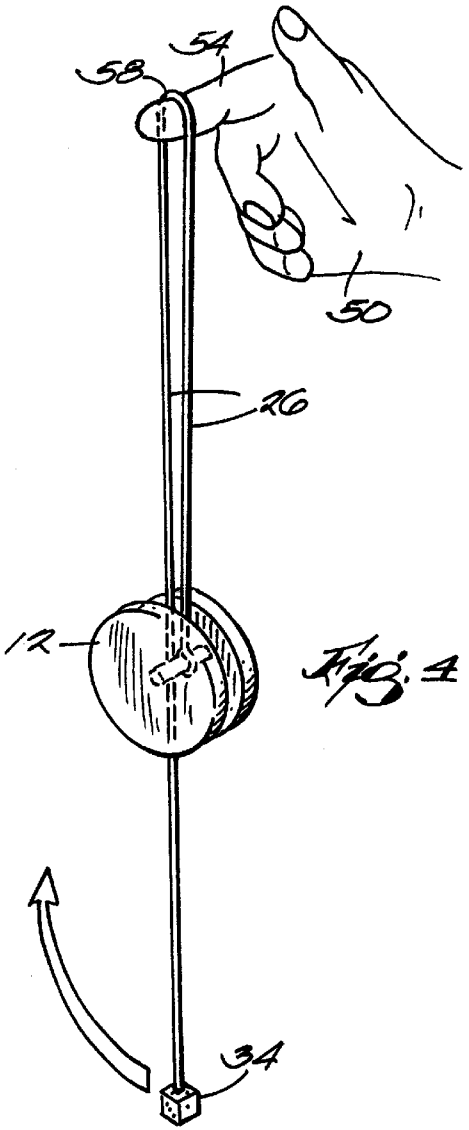
FIG. 4 is an illustration of a player using the yo-yo of FIG. 1.

As seen in FIGS. 3 and 4, the Trapeze may be improved by the present invention. As shown, a player 42 has a first throwing hand 46 (the left hand in the illustration) and a second free hand 50. The Trapeze is executed as described above, with a finger 54 of the second hand 50 supporting the string 26 at a point 58 between the yo-yo body 12 and the solid body 34. Once the yo-yo body 12 is supported by the string 26 between the player's hands 46, 50, the player 42 releases the solid body 34 from the first hand 46, and spins or twirls the solid body 34 and yo-yo body 12 on the finger 54 of the second hand 50 about the point 58 on the string 26. If the yo-yo 10 is a long-spinning yo-yo (e.g., a yo-yo adapted to sleep for an extended period of time), the player 42 may twirl the yo-yo 10 several times on the finger 54. When the player 42 wishes to end the trick, the player 42 catches the solid body 34 with the first hand 46 and completes the trick as described above.

Another traditional trick that can be improved with the illustrated yo-yo is the Bottom Mount. The Bottom Mount is executed by causing the yo-yo to sleep, and then running a finger of the second hand down the string, causing the yo-yo to hop up. The first and second hands are held substantially at the same height, and the yo-yo body is caught and cradled on the string between the hands. The first and second hands are then circled or "somersaulted" about each other in an orbiting fashion around the yo-yo body. To end the trick, the player moves the first and second hands away from each other to cause the yo-yo body to jump off the string.

Figure 5:
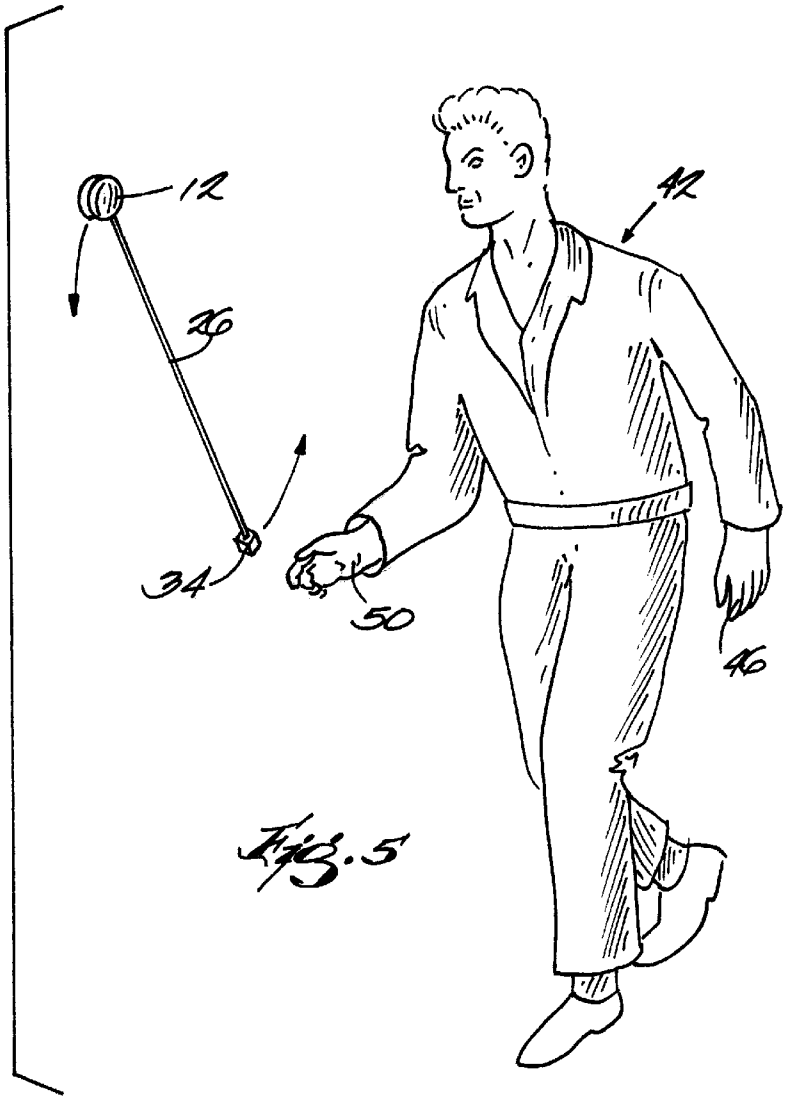
FIG. 5 is an illustration of a player using the yo-yo of FIG. 1.

With the illustrated yo-yo 10, and as seen in FIG. 5, during the somersault portion of the Bottom Mount trick, the player 42 can move the hands 46, 50 apart quickly and release the solid body 34, causing the yo-yo body 12 and solid body 34 to fly through the air, doing a complete turn with the string 26 extended between them. The player 42 then catches the solid body 34 and continues playing with the yo-yo 10.

In addition to the specific tricks described above, the player 42 may enhance virtually any trick by being able to throw the solid body 34 from the first hand 46 and catch it in the first hand 46, or alternatively, transferring the solid body 34 between the firsthand 46 and the second hand 50. Some tricks may be executed with the illustrated yo-yo I 0 that are not possible with traditional yo-yos. For example, the yo-yo 10 may be released and passed entirely around a body part of the player 42, such as an arm, leg, or waist, and caught on the other side of the player's body part. Also, if the solid body 34 is a rubber ball, even more intricate tricks may be performed by bouncing the ball off of a surface during a trick.

What is claimed is:

1. A method for using a yo-yo having a yo-yo body, an axle, and a string having a first end interconnected with the axle, the string being windable about the axle, the method comprising:

providing a solid body;

interconnecting the solid body with the string;

spinning the yo-yo body about the axle to cause the string to selectively wind and unwind about the axle; and selectively holding and releasing the solid body while the yo-yo body is spinning.

2. The method of claim 1, wherein said providing a solid body step includes providing a weight.

3. The method of claim 1, wherein the string includes a second end opposite the first end, and wherein said interconnecting step includes interconnecting the solid body with the second end of the string.

4. The method of claim 1, further comprising:

holding the string at a point between the solid body and the yo-yo body while the yo-yo body is spinning; and moving the solid body with respect to the point.

5. The method of claim 1, wherein said spinning step includes making the yo-yo body sleep.

6. The method of claim 1, wherein said providing a solid body step includes providing a rubber ball, and wherein said selectively holding step includes bouncing said rubber ball while said yo-yo body is spinning.

7. The method of claim 1, wherein said providing a solid body step includes providing a die.

8. A yo-yo comprising:

first and second yo-yo body portions;

an axle joining said first and second yo-yo body portions;

a string interconnected with said axle; and a solid body interconnected with said string, said solid body including a rubber ball.

9. The yo-yo of claim 8, wherein said string includes a first end interconnected with said axle, and a second end interconnected with said solid body.

* * * * *